United States Patent [19]

Tedesco

[11] Patent Number: 4,644,120

[45] Date of Patent: Feb. 17, 1987

[54] MOLDED CASE CIRCUIT BREAKER WITH A MOVABLE LOWER ELECTRICAL CONTACT POSITIONED BY A TORSION SPRING

[75] Inventor: Robert J. Tedesco, Coraopolis, Pa.

[73] Assignee: Westinghouse Electric Corp., Pittsburgh, Pa.

[21] Appl. No.: 756,485

[22] Filed: Jul. 18, 1985

[51] Int. Cl.[4] ..... H01N 1/24

[52] U.S. Cl. ..... 200/153 G; 200/250

[58] Field of Search ..... 200/153 G, 153 SC, 153 W, 200/250, 249, 245, 239

[56] References Cited

U.S. PATENT DOCUMENTS

| | | | |
|---|---|---|---|
| 1,334,784 | 3/1920 | Newton | 200/153 W |
| 1,807,815 | 6/1931 | White | 200/250 X |
| 2,065,357 | 12/1936 | Von Hoorn | 200/153 G |
| 2,862,075 | 11/1958 | Netzel | 200/153 G |
| 3,286,067 | 11/1966 | Menickella et al. | 200/153 G |
| 3,293,397 | 12/1966 | Zubaty et al. | 200/153 G |
| 3,590,192 | 6/1971 | Bould et al. | 200/153 SC |
| 4,472,701 | 9/1984 | Bellows et al. | 200/153 G X |
| 4,554,427 | 11/1985 | Flick et al. | 200/250 |

*Primary Examiner*—Henry S. Jaudon
*Assistant Examiner*—T. G. Graveline
*Attorney, Agent, or Firm*—D. S. Buleza

[57] ABSTRACT

A molded case circuit breaker includes a movable lower electrical contact assembly having a formed stationary conductor member, a movable lower contact arm, a lower contact secured to the upper end of the movable lower contact arm for physically and electrically contacting separate upper electrical contacts, and a lower contact arm torsion spring. An integral longitudinal end of the stationary conductor member extends from the base of the circuit breaker to form an external terminal of the circuit breaker. The opposite longitudinal end of the stationary conductor member receives a rotatable pin fixedly secured to the movable lower contact arm for rotation therewith. The lower contact arm torsion spring has an elongated torsion spring arm disposed in contact with an elongated inclined cam surface located on the underside of the movable lower contact arm to bias the lower contact secured thereto into engagement with the upper electrical contact. A groove is provided along the elongated cam surface of the lower contact arm within which a torsion spring arm of the torsion spring may be releasably received. Upon the occurrence of a high level short circuit or fault current condition, as the movable lower contact arm separates from the upper electrical contact the torsion spring arm moves along the elongated inclined cam surface of the arm which is so contoured that the force of the torsion spring opposing the movement of the movable lower contact arm is minimized, thereby enabling the rapid separation of the upper and lower electrical contacts.

13 Claims, 26 Drawing Figures

126
128
124
126
130
130
152
158
156
158
90
166
100
88
150
152
168
166
92
164
160
164
176
100
122
176
154
86
182
98
148
134
180
178
108
178
136
86
124
96
140
162
132
182
162
132
190
180
163
142
102
188
188
92
102
116
120
104
190
116
118
106
118
112
52
104
112
110
206
206
224
52
114
224
114
242
222
202
84
242
222
204
202
204
212
234
204
212
234
212
202
194
186
196
216
194
220
194
216
186
196
216
218
218
217
215
210
214
208

MOLDED CASE CIRCUIT BREAKER WITH A MOVABLE LOWER ELECTRICAL CONTACT POSITIONED BY A TORSION SPRING

CROSS REFERENCE TO RELATED APPLICATIONS

The invention disclosed herein relates to molded case circuit breakers.

The following six commonly assigned U.S. patent applications were all fixed in the U.S. Patent and Trademark Office on Dec. 19, 1983 and relate to molded case circuit breakers: Ser. No. 562,647 (now U.S. Pat. No. 4,540,961); Ser. No. 562,648 (now U.S. Pat. No. 4,539,538); Ser. No. 562,643 (now U.S. Pat. No. 4,528,531); Ser. No. 562,644 (now U.S. Pat. No. 4,551,597); Ser. No. 562,602 (now U.S. Pat. No. 4,554,427); and Ser. No. 562,603.

The following six commonly assigned U.S. patent applications were filed in the U.S. Patent and Trademark Office on Jan. 9, 1984 and relate to molded case circuit breakers: Ser. No. 569,059 (now abandoned); Ser. No. 569,058 (now U.S. Pat. No. 4,553,116); Ser. No. 569,057 (now U.S. Pat. No. 4,554,423); Ser. No. 569,056 (abandoned in lieu of application Ser. No. 719,036, now U.S. Pat. No. 4,554,421); Ser. No. 569,055; and Ser. No. 569,054 (now U.S. Pat. No. 4,553,115).

The following five commonly assigned U.S. patent applications were filed in the U.S. Patent and Trademark Office on Sept. 28, 1984 and relate to molded circuit breakers: Ser. No. 06/655,952 (now U.S. Pat. No. 4,581,511); Ser. No. 06/655,957; Ser. No. 06/655,956; Ser. No. 06/655,955 (now U.S. Pat. No. 4,563,557); and Ser. No. 06/655,954 (now U.S. Pat. No. 4,594,491).

Finally, the following five commonly assigned U.S. patent applications were filed in the U.S. Patent and Trademark Office on the same day (July 18, 1985) as this patent application, relate to molded circuit breakers, and are hereinto incorporated by reference; Ser. No. 06/756,489 entitled Molded Case Circuit Breaker With Combined Position Indicator And Handle Barrier by James R. Farley and Robert H. Flick; Ser. No. 06/756,484 entitled Molded Case Circuit Breaker With An Improved Contoured Cradle by Robert Tedesco; Ser. No. 06/756,488 entitled Molded Case Circuit Breaker With A Movable Electrical Contact Positioned By A Spring Loaded Ball by Joseph F. Changle; Ser. No. 06/756,487 entitled Molded Case Circuit Breaker With A Movable Electrical Contact Positioned By A Camming Spring Loaded Clip by Robert Tedesco and David Haggerty; and Ser. No. 06/756,486 entitled Molded Case Circuit Breaker With An Improved Operating Mechanism Having A Pivot-Transfer Trip-Free Linkage by Robert Tedesco and Joseph F. Changle. Commonly assigned U.S. patent application Ser. No. 06/756,490, entitled Molded Case Circuit Breaker With A Movable Electrical Contact Positioned By A Camming Leaf Spring, filed July 19, 1985 by Charles R. Paton and Charles E. Haugh, is another related application and is hereinto incorporated by reference.

BACKGROUND OF THE INVENTION

A. Field of the Invention

The device of the present invention generally relates to molded case circuit breakers and, more particularly, to electrical contacts for molded case circuit breakers.

B. Description of the Prior Art

Circuit breakers and, more particularly molded case circuit breakers are old and well known in the prior art. Examples of such devices are disclosed in United States Letters Patents Nos. 2,186,251; 2,492,009; 3,239,638; 3,525,959; 3,590,325; 3,614,685; 3,775,713; 3,783,423; 3,805,199; 3,815,059; 3,863,042; 3,959,695; 4,077,025; 4,166,205; 4,258,403; and 4,295,025. In general, prior art molded case circuit breakers have been provided with movable contact arrangements and operating mechanisms designed to provide protection for an electrical circuit or system against electrical faults, specifically, electrical overload conditions, low level short circuit or fault current conditions, and, in some cases, high level short circuit or fault current conditions. Prior art devices have utilized an operating mechanism having a trip mechanism for controlling the movement of an over-center toggle mechanism to separate a pair of electrical contacts upon an overload condition or upon a short circuit or fault current conditions. At least some prior art devices use contacts that "blow-open", i.e., separate prior to the sequencing of the operating mechanism through a trip operation, to rapidly interrupt the flow of high level short circuit or fault current. In such devices, the lower electrical contact of the blown-apart contacts may be stationary or it may be movable. Movable lower electrical contacts have utilized a compression spring for biasing the lower electrical contact into engagement with the upper electrical contact in a CLOSED position during normal operation of the circuit breaker. In such contacts, the force of the compression spring opposes the movement of the movable lower electrical contact during high level short circuit or fault current conditions.

While many prior art devices have provided adequate protection against fault conditions in electrical circuits, a need exists for dimensionally small molded case circuit breakers capable of fast, effective and reliable operation and, more specifically, for a compact, lower electrical contact capable of rapid movement away from an associated upper electrical contact during high level short circuit or fault current conditions.

SUMMARY OF THE INVENTION

An object of the present invention is to provide a new and improved circuit breaker.

Another object of the present invention is to provide a new and improved molded case circuit breaker having a compact, movable lower electrical contact capable of rapid movement away from an upper electrical contact during high level short circuit or fault current conditions.

Briefly, the present invention relates to a molded case circuit breaker having a new and improved movable lower electrical contact that occupies a relatively small amount of space while providing effective and reliable operation in protecting an electrical circuit or system from electrical overload or fault current conditions. The movable lower electrical contact assembly includes a formed stationary conductor member secured to the base of the circuit breaker by a mounting screw, a movable lower contact arm, a lower contact for physically and electrically contacting a separate upper electrical contact and a lower contact arm biasing means such as a torsion spring.

An integrally formed, longitudinal end portion of the stationary conductor member extends through the base of the circuit breaker to form an external terminal of the circuit breaker. The opposite longitudinal end of the stationary conductor member is configured as an upstanding contacting portion. The movable lower contact arm is fixedly secured to a rotatable pin for rotation therewith on the upstanding contacting portion of the stationary conductor member. The lower contact for physically and electrically contacting the separate upper electrical contact is secured to the upper end of the movable lower contact arm. Thus, a current carrying conductive path is formed between the external terminal and the lower contact mounted at the upper end of the movable contact arm through the stationary conductor member and its upstanding contacting portion, the rotatable pin and the lower contact arm.

The movable lower contact arm includes an, elongated inclined cam surface of predetermined contour that is formed on the underside of the contact arm. The torsion spring includes a cam follower spring arm that contacts the inclined cam surface of the movable lower contact arm to bias the lower contact secured thereto into engagement with the upper electrical contact. Upon the occurrence of a high level short circuit or fault current condition, the resultant high magnetic repulsion forces generated by the flow of fault current through generally parallel portions of the upper and lower electrical contact assemblies cause the rapid downward movement of the movable lower contact arm. As the cam follower arm of the torsion spring moves along the inclined cam surface of the movable lower contact arm of the lower electrical contact assembly the spring force of the torsion spring opposing movement of the lower contact arm during a BLOWN-OPEN operation is reduced. An extremely rapid separation of the upper and lower electrical contacts is thus achieved to provide effective fault current limitation.

BRIEF DESCRIPTION OF THE DRAWING

The above and other objects and advantages and novel features of the present invention will become apparent from the following detailed description of the preferred and alternative embodiments of a molded case circuit breaker illustrated in the accompanying drawing wherein.

DESCRIPTION OF THE PREFERRED EMBODIMENT

Figure 1:
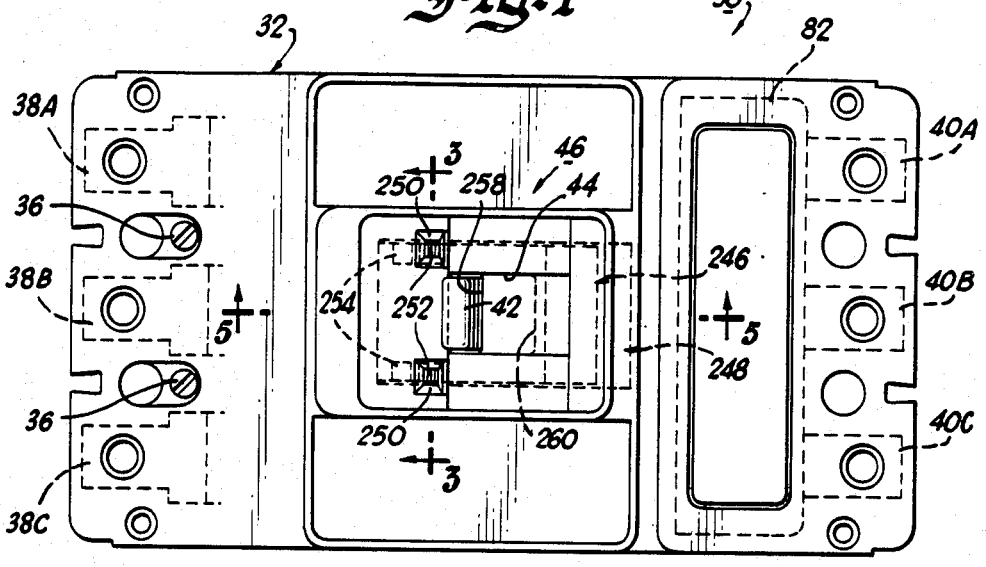
FIG. 1 is a top plan view of a molded case circuit breaker constructed in accordance with the teachings of this invention.

Referring to the drawing and initially to FIGS. 1-17, there is illustrated a new and improved molded case circuit breaker 30 constructed in accordance with the principles of the present invention. While the circuit breaker 30 is depicted and described herein as a three phase or three pole circuit breaker, the principles of the present invention disclosed herein are equally applicable to single phase or other polyphase circuit breakers and to both AC circuit breakers and DC circuit breakers.

The circuit breaker 30 includes a molded, electrically insulating, top cover 32 mechanically secured to a molded, electrically insulating, bottom cover or base 34 by a plurality of fasteners 36. A plurality of first electrical terminals or line terminals 38A, 38B and 38C are provided, one for each pole or phase, as are a plurality of second electrical terminals or load terminals 40A, 40B and 40C. These terminals are used to serially electrically connect the circuit breaker 30 into a three phase electrical circuit for protecting a three phase electrical system.

Figure 14:
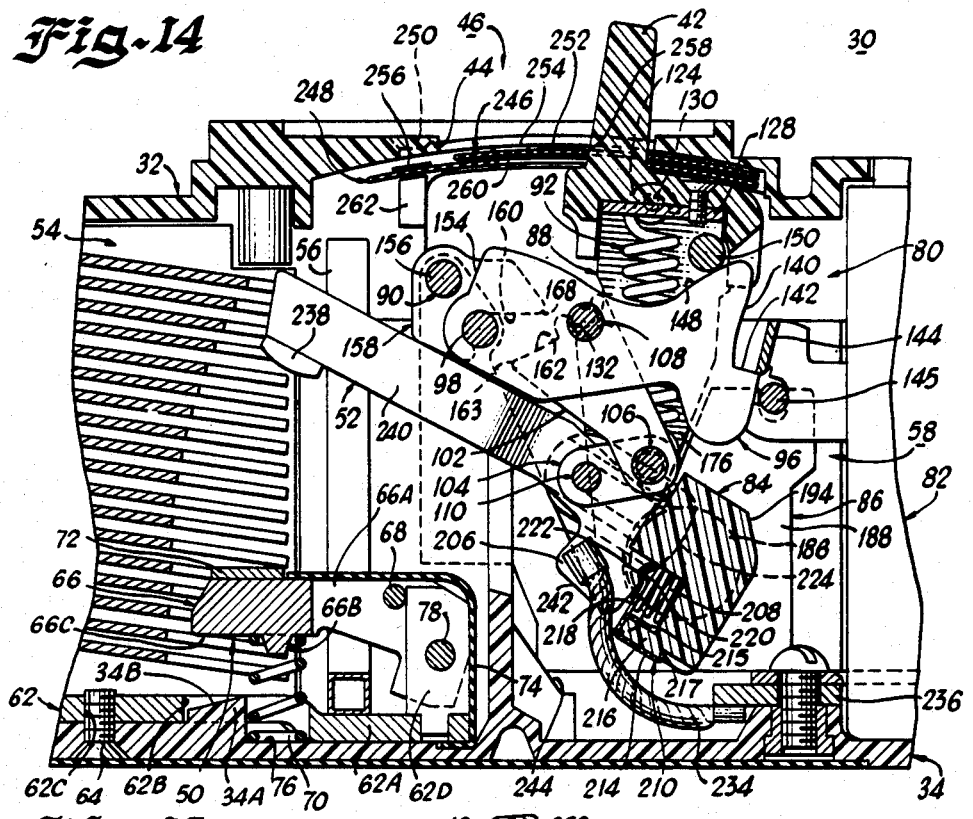
FIG. 14 is an enlarged, fragmentary, cross sectional view of the center pole or phase of the device of FIG. 1, depicting the device in its OPEN position.
Figure 15:
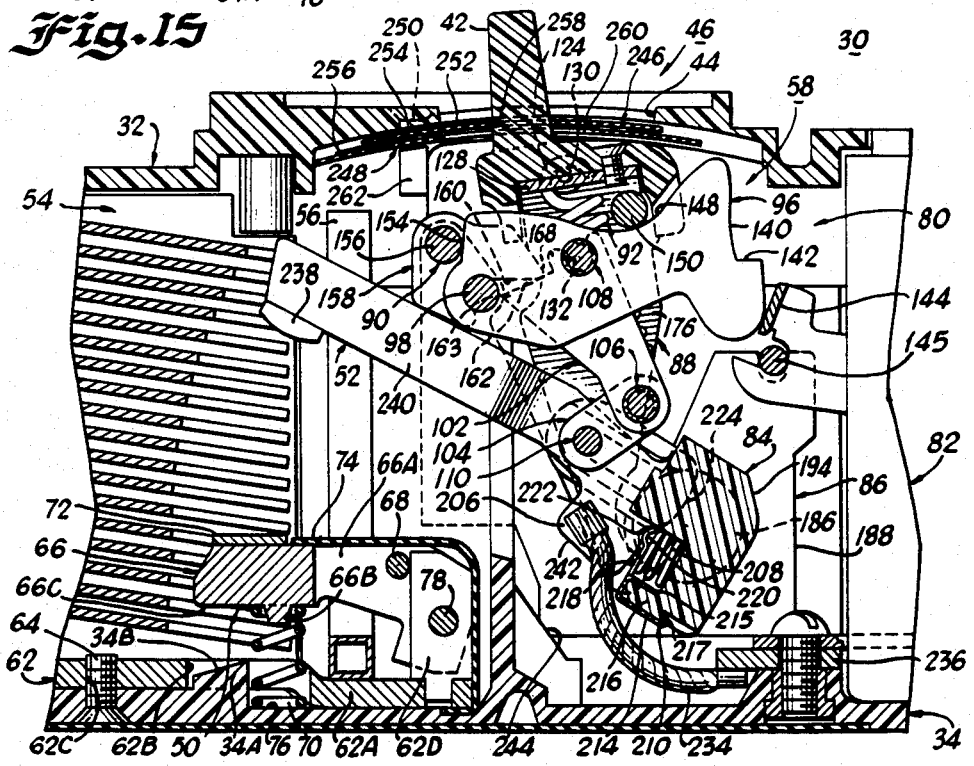
FIG. 15 is an enlarged, fragmentary, cross sectional view of the center pole or phase of the device of FIG. 1, depicting the device in its TRIPPED position.

The circuit breaker 30 further includes an electrically insulating, rigid, manually engageable handle 42 extending through an opening 44 in the top cover 32 for setting the circuit breaker 30 to its CLOSED position (FIG. 5) or to its OPEN position (FIG. 14). The circuit breaker 30 also may assume a BLOWN-OPEN position (FIG. 5, dotted line position) or a TRIPPED position (FIG. 15). Subsequent to moving to its TRIPPED position, the circuit breaker 30 may be reset for further protective operation by moving the handle 42 from its TRIPPED position (FIG. 15) to and past its OPEN position (FIG. 14). The handle 42 may then be left in its OPEN position (FIG. 14) or moved to its CLOSED position (FIG. 5), in which case the circuit breaker 30 is ready for further protective operation. The movement of the handle 42 may be achieved either manually or automatically by a mechanical actuator. A position indicator 46 provides an externally visually discernible indication of the condition or position of the circuit breaker 30. The position indicator 46 is disposed about the handle 42 and covers the bottom of the opening 44 to function as a mechanical and electrical barrier between the interior and exterior of the circuit breaker 30.

As its major internal components (FIG. 5), the circuit breaker 30 includes a lower electrical contact assembly 50 having a lower contact 72, an upper electrical contact assembly comprising a pair of contact members 52 and upper contacts 238, an electrical arc chute 54, a slot motor 56, and an operating mechanism 58. The contact 72 is carried by a lower contact arm 66 and contacts 238 are integral with a pair of upper contact arms 240. The arc chute 54 and the slot motor 56 are conventional, per se, and thus are not discussed in detail hereinafter. Briefly, the arc chute 54 is used to divide a single electrical arc formed between the separating electrical contacts 72 and 238 upon a fault condition into a series of smaller electrical arcs, increasing the total arc voltage and resulting in extinguishing of the electrical arc. The slot motor 56, consisting either of a series of generally U-shaped steel laminations encased in lectrical insulation or of a generally U-shaped, electrically insulated, solid steel bar, is disposed about the contact arms 66 and 240 to concentrate the magnetic field generated upon a high level short circuit or fault current condition, thereby greatly increasing the magnetic repulsion forces between the separating electrical contact arms 66 and 240 to rapidly accelerate the separation of the electrical contacts 72 and 238. The rapid separation of the electrical contacts 72 and 238 results in a relatively high arc resistance to limit the magnitude of the fault current. Reference may be had to U.S. Pat. No. 3,815,059 for a more detailed description of the arc chute 54 and the slot motor 56.

Figure 2:
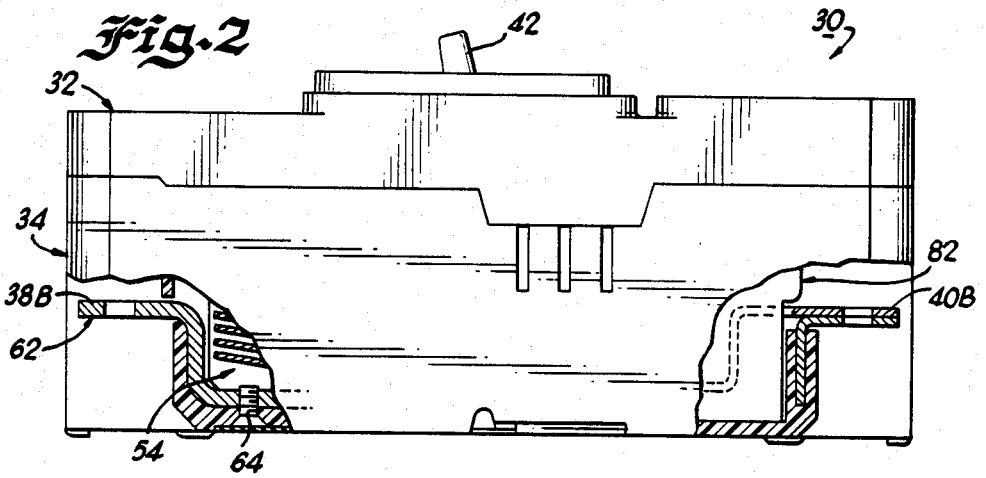
FIG. 2 is a side elevational view of the device of FIG. 1, portions being deleted to show interior details.
Figure 3:
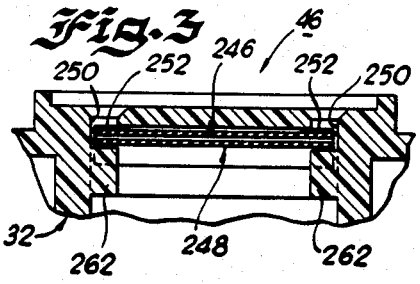
FIG. 3 is an enlarged, fragmentary, cross sectional view of the device of FIG. 1 taken along line 3—3 of FIG. 1.
Figure 4:
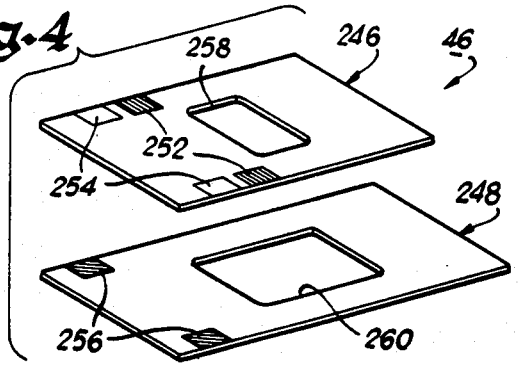
FIG. 4 is an enlarged perspective view of a pair of electrically insulating barrier indicator cards of the device of FIG. 1.

The lower electrical contact assembly 50 (FIGS. 5, 14 and 15) includes a lower, formed, stationary conductor member 62 secured to the base 34 by a fastener 64, a lower movable contact arm 66, a limit or stop pin 68 fixedly secured to and movable with the movable contact arm 66, a lower contact biasing means or compression spring 70, a contact 72 for physically and electrically contacting the upper electrical contacts 238 and an electrically insulating strip 74 to reduce the possibility of arcing between the upper electrical contact members 52 and portions of the lower electrical contact assembly 50. The line terminal 38B extending exteriorly of the base 34 comprises an integral end portion of the conductor member 52 (FIG. 2). The base 34 includes an upwardly protuberant portion 34A having an upper, inclined surface 34B that serves as a lower limit or stop for the moving contact arm 66 during the rapid separation of the upper contact members 52 from the lower contact assembly 50. The lower, formed stationary conductor member 62 includes a lower portion 62A that engages the base 34. An aperture 62B is formed through the lower portion 62A for receiving the upwardly extending base portion 34A and for seating the compression spring 70. The lower portion 62A may also include a threaded aperture 62C formed therethrough for receiving the fastener 64 to secure the stationary conductor member 62 and thus the lower electrical contact assembly 50 to the base 34. The stationary conductor member 62 includes an upstanding, contacting portion 62D that may be integrally formed with or fixedly secured to the lower portion 62A. The stop pin 68 (FIG. 5) is provided for limiting the upward movement of the movable contact arm 66 upon physical engagement with the upstanding contacting portion 62D.

The contact arm 66 is fixedly secured to a rotatable pin 78 for rotation therewith on the upstanding contacting portion 62D about the longitudinal axis of the rotatable pin 78. Effective conductive contact and current transfer is achieved between the lower formed stationary member 62 and the lower movable contact arm 66 through the rotatable pin 78. The lower movable contact arm 66 includes an elongated rigid lever arm 66A extending between the rotatable pin 78 and the contact 72 and a downwardly protuberant portion or spring locator 66B for receipt within the upper end of the compression spring 70 for maintaining effective physical interconnection between the lower movable arm 66 and the compression spring 70. Finally, the lower movable contact arm 66 includes an integrally formed, flat surface 66C formed at its lower end for physically engaging the stop 34B to limit the downward movement of the lower movable contact arm 66 and the contact 72 fixedly secured thereto.

Figure 5:
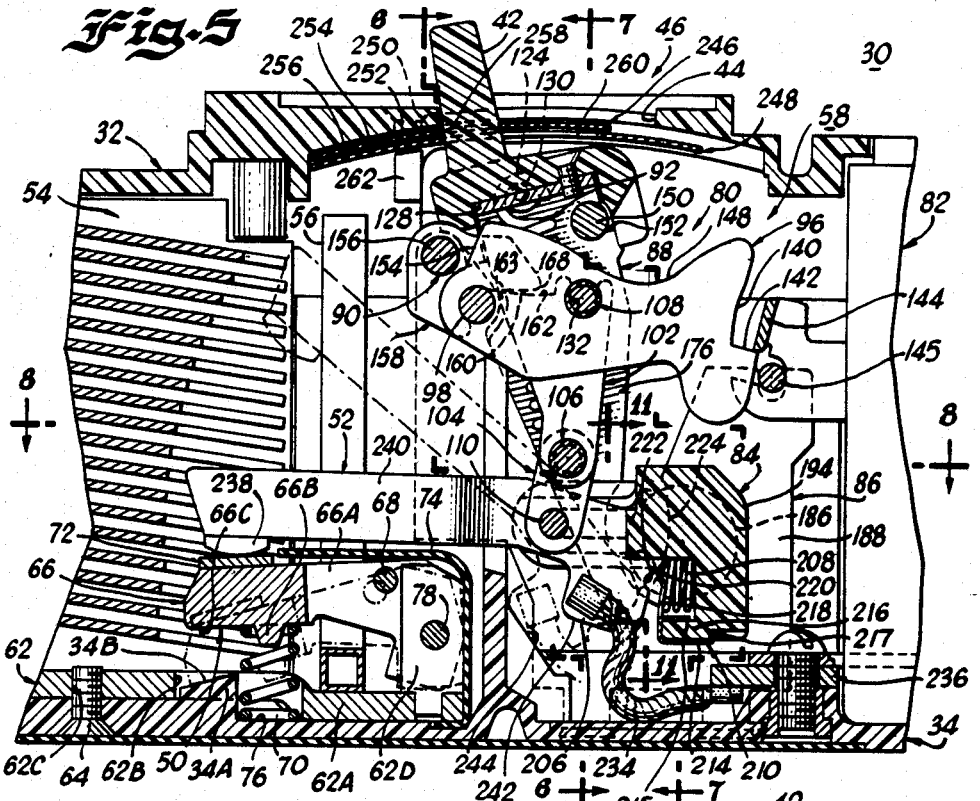
FIG. 5 is an enlarged, cross sectional view of the device of FIG. 1 taken along the line 5—5 of FIG. 1, depicting the device in its CLOSED and BLOWNOPEN positions.
Figure 8:
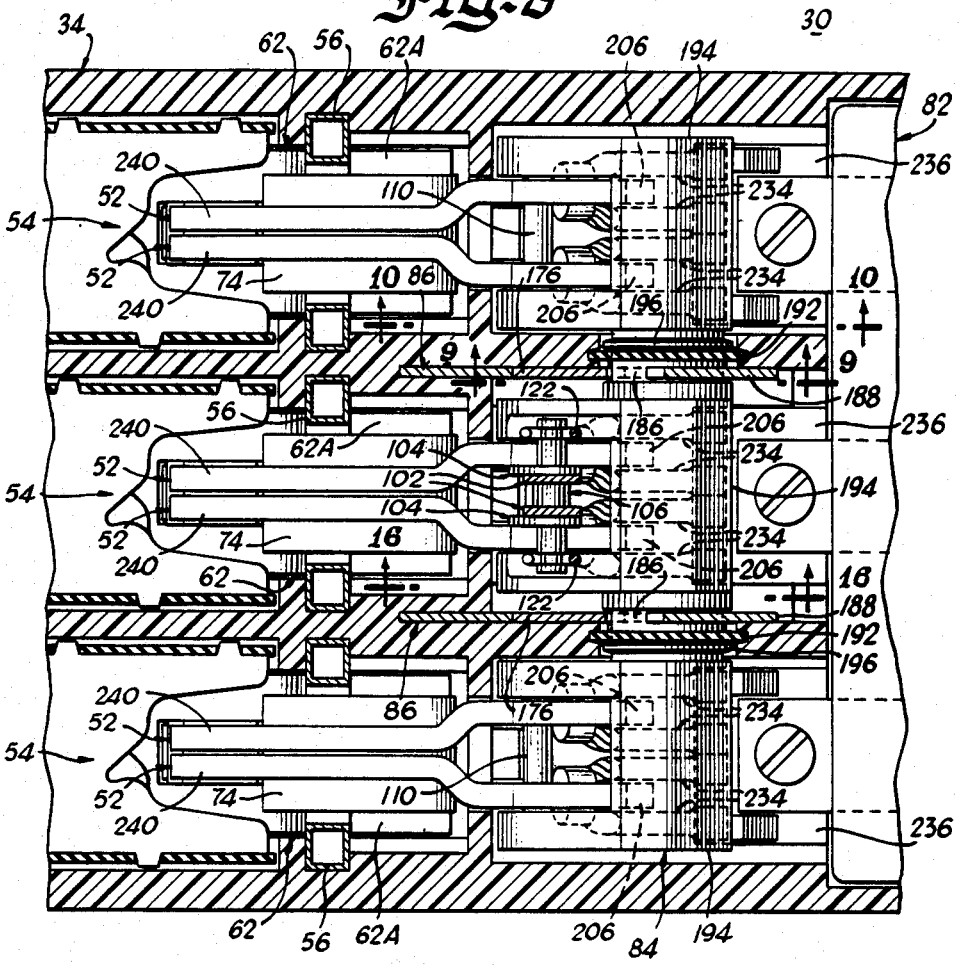
FIG. 8 is an enlarged, fragmentary, cross sectional view of the device of FIG. 1 taken along line 8—8 of FIG. 5.
Figure 9:
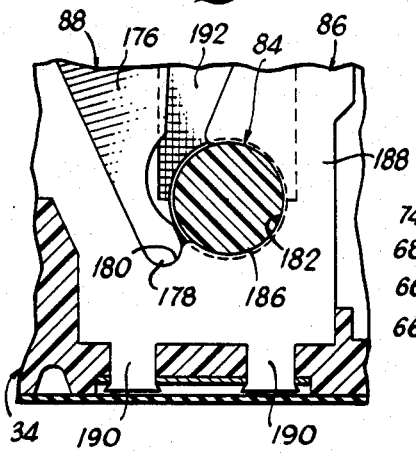
FIG. 9 is an enlarged, fragmentary, cross sectional view of the cross-bar assembly of the device of FIG. 1 taken along line 9—9 of FIG. 8.
Figure 10:
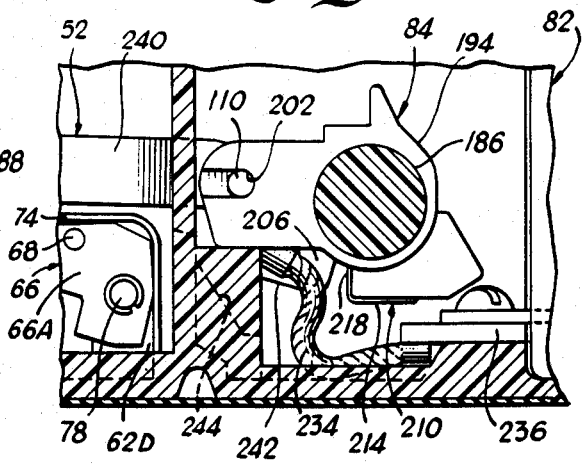
FIG. 10 is an enlarged fragmentary, cross sectional view of the cross-bar assembly of the device of FIG. 1 taken along line 10—10 of FIG. 8.

Each upper electrical contact member 52 has a current contact 238 for physically and electrically contacting the contact 72 of the lower electrical contact assembly 50. The contacts 238 are disposed at the ends of a pair of upper movable elongated contact arms 240 (as shown in FIGS. 5 and 8). It is the passage of high level short circuit or fault current through the generally parallel contact arms 66 and 240 that causes very high magnetic repulsion forces between the contact arms 66 and 240, effecting the extremely rapid separation of the contacts 72 and 238. The electrically insulating strip 74 is used to electrically insulate the upper contact arms 240 from the lower contact arm 66.

The lower electrical contact assembly 50 as described hereinabove utilizes the high magnetic repulsion forces generated by high level short circuit or fault current flowing through the elongated parallel portions of the electrical contact arms 66 and 240 to cause the rapid downward movement of the contact arm 66 against the bias of the compression spring 70 (FIG. 5). An extremely rapid separation of the electrical contacts 72 and 238 and a resultant rapid increase in the resistance across the electrical arc formed between the electrical-contacts 72 and 238 is thereby achieved, providing effective fault current limitation within the confines of relatively small physical dimensions. The lower electrical contact assembly 50 further eliminates the necessity for utilizing flexible copper shunts used in many prior art molded case circuit breakers for prviding a current carrying conductive path between a terminal of the circuit breaker and a lower movable contact arm of a lower electrical contact.

The operating mechanism 58 (FIGS. 5, 13 and 16) includes an over-center toggle mechanism 80; an electronic or thermal-magnetic trip mechanism 82 (not shown in detail); an integral or one-piece molded cross-bar 84 (FIG. 13); a pair of rigid, opposed or spaced apart, metal side plates 86; a rigid, pivotable, metal handle yoke 88; a rigid stop pin 90; and a pair of operating tension springs 92.

The over-center toggle mechanism 80 includes a rigid, one-piece metal cradle 96 that is rotatable about the longitudinal axis of a cradle support pin 98. The opposite longitudinal ends of the cradle support pin 98 in an assembled condition are retained in a pair of apertures 100 formed through the side plates 86.

Figure 6:
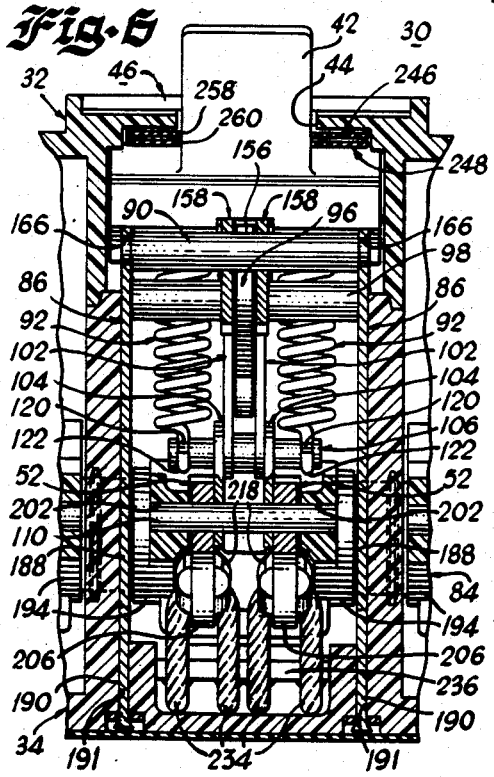
FIG. 6 is an enlarged, fragmentary, cross sectional view of the device of FIG. 1 taken along line 6—6 of FIG. 5.

The toggle mechanism 80 further includes a pair of upper toggle or kicker links 102, a pair of lower toggle links 104, a toggle spring pin 106 and an upper toggle link follower pin 108. The lower toggle links 104 are secured to the upper electrical contact members 52 by a toggle contact pin 110. Each of the lower toggle links 104 includes a lower aperture 112 for receipt therethrough of the toggle contact pin 110. The toggle contact pin 110 also passes through an aperture 114 formed through each of the upper electrical contact members 52 enabling the upper electrical contact members 52 to freely rotate about the central longitudinal axis of the pin 110. The opposite longitudinal ends of the pin 110 are received and retained in the cross-bar 84 (FIG. 6). The movement of the lower toggle links 104 causes the movement of the cross-bar 84 and the corresponding movement of the upper electrical contact members 52 under other than high level short circuit or fault current conditions. In this manner, movement of the upper electrical contact members 52 in the center pole or phase of the circuit breaker 30 by the operating mechanism 58, simultaneously, through the rigid cross-bar 84, causes the same movement in the upper electrical contact members 52 associated with the other poles or phases of the circuit breaker 30.

Figure 7:
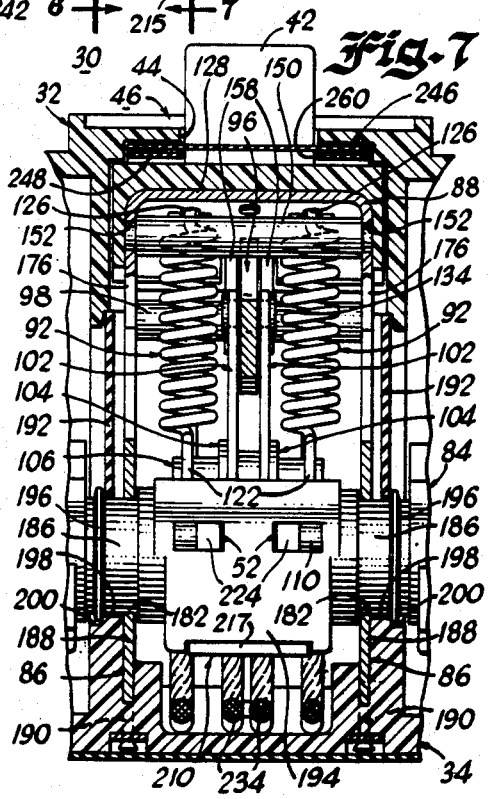
FIG. 7 is an enlarged fragmentary, cross sectional view of the device of FIG. 1 taken along line 7—7 of FIG. 5.

Each of the lower toggle links 104 also includes an upper aperture 116; and each of the upper toggle links 102 includes an aperture 118. The toggle spring pin 106 is received through the apertures 116 and 118, thereby interconnecting the upper and lower toggle links 102 and 104 and allowing rotational movement therebetween. The opposite longitudinal ends of the pin 106 include journals 120 for the receipt and retention of the lower, hooked or curved ends 122 of the springs 92. The upper, hooked or curved ends 124 of the springs 92 are received through and positioned in slots 126 formed through an upper, planar or flat surface 128 of the handle yoke 88. A locating pin 130 is transversely disposed across the slots 126 for retaining the curved ends 124 of the springs 92 in engagement with the handle yoke 88 (FIG. 7).

In an assembled condition, the disposition of the curved ends 124 within the slots 126 and the disposition of the curved ends 122 in the journals 120 retain the links 102 and 104 in engagement with the pin 106 and also maintain the springs 92 under tension, enabling the operation of the over-center toggle mechanism 80 to be controlled by and responsive to external movements of the handle 42.

The upper links 102 (FIG. 13) also include a recess or groove 132 which mates with a pair of spaced apart journals 134 formed along the length of the pin 108. The center portion of the pin 108 is configured to be fixedly received in an aperture 136 formed through the cradle 96 at a location spaced by a predetermined distance from the axis of rotation of the cradle 96 coincident with the longitudinal axis of the pin 98. The spring tension from the springs 92 retains the upper toggle links 102 in engagement with the pin 108. The rotational movement of the cradle 96 effects a corresponding movement or displacement of the upper portions of the links 102 as is described hereinafter.

Figure 17:
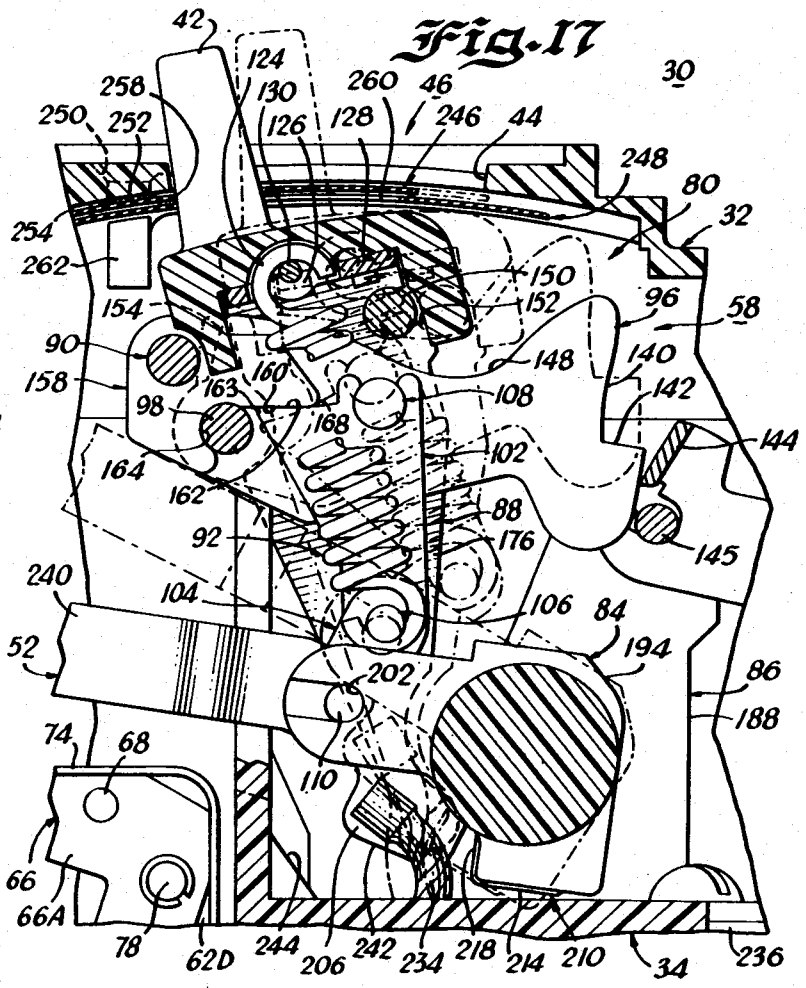
FIGS. 16 and 17 are enlarged, fragmentary, cross sectional views of the device of FIG. 1 depicting sequential positions of the operating mechanism of the device of FIG. 1 during a trip occurrence.
Figure 16:
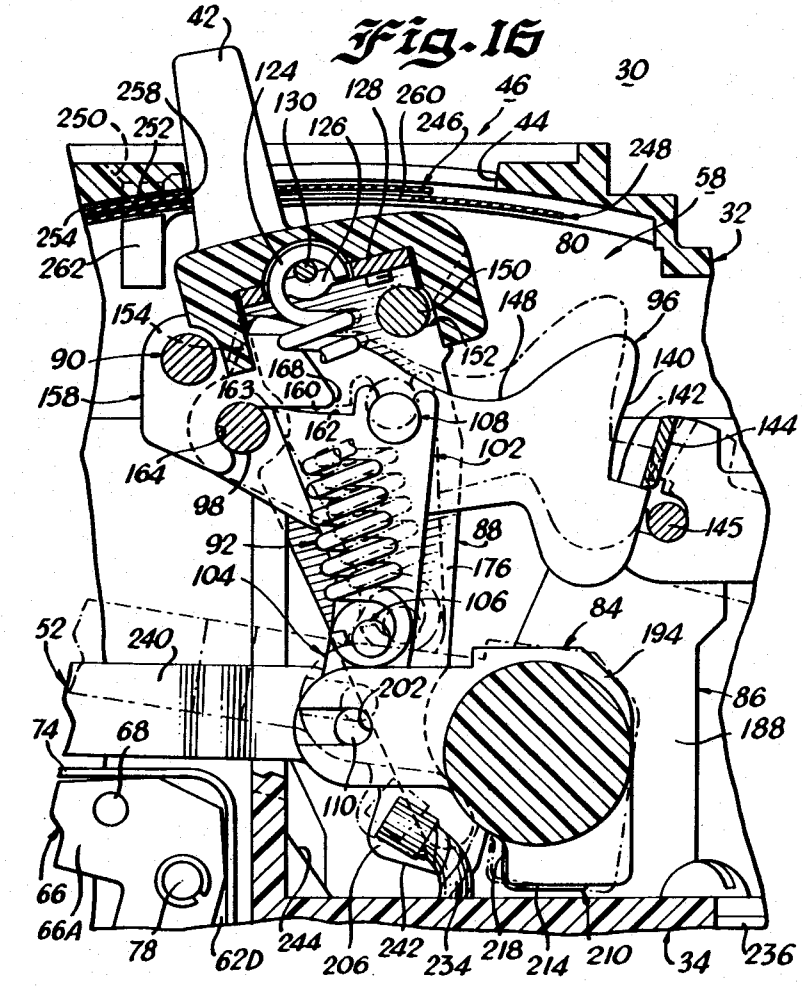

The cradle 96 includes an elongated surface 140 having a generally flat latch surface 142 formed therein. The surface 142 is configured to engage a pivotable lever or trip arm 144 (FIGS. 5, 16 and 17) of the trip mechanism 82. The trip arm 144 pivots about a stationary pin 145 of the trip mechanism 82 upon a trip operation initiated by the trip mechanism 82. The trip mechanism 82 is an electronic or thermal-magnetic trip mechanism that is capable of detecting both low level short circuit or overload current conditions and high level short circuit or fault current conditions. Upon the detection of any such condition the trip mechanism 82 rotates the trip arm 144 about the pivot pin 145 to initiate a trip operation of the operating mechanism 58 (FIGS. 16 and 17).

The cradle 96 also includes a curved, elongated cam surface 148 for contacting a cradle cam or limit pin 150. The opposite longitudinal ends of the cam pin 150 are received and retained in a pair of grooves 152 formed in the handle yoke 88, to enable, in the preferred embodiment, the rotation of the pin 150 within the handle yoke 88. The cradle 96 further includes a generally flat stop surface 154 for contacting a central portion or rigid stop 156 of the stop pin 90. The engagement of the surface 154 with the rigid stop 156 limits the movement of the cradle 96 in a counterclockwise direction subsequent to a trip operation (FIGS. 15 and 17).

During a trip operation, the lines of action of the operating springs 92 are changed, resulting in the movement of the handle 42 to a TRIPPED position (FIG. 15), intermediate the CLOSED position (FIG. 5) and the OPEN position (FIG. 14) of the handle 42, to indicate that the circuit breaker 30 has tripped. The engagement of the stop surface 154 and rigid stop 156 limits the movement of the cradle 96 and thereby locates the handle 42 in the TRIPPED position (FIG. 15) through the engagement of the pin 150 with the cam surface 148 of the cradle 96. In addition, the camming engagement of the cam surface 148 and rotatable pin 150 resets the operating mechanism 58 subsequent to a trip operation as the cradle 96 moves in a clockwise direction against the bias of the operating springs 92 from its TRIPPED position (FIG. 15) to and past its OPEN position (FIG. 14), thereby relatching the latch surface 142 and the trip arm 144. The cam surface 148 is configured to increase the mechanical advantage of the handle 42 in a predetermined manner in accordance with the specific design or contour of the cam surface 148 as the springs 92 are extended during a reset operation. In this manner only a comparatively low and substantially constant reset force applied to the handle 42 is required to achieve the resetting of the operating mechanism 58 after a trip operation and to move the handle 42 between its TRIPPED and OPEN positions.

Figure 18:
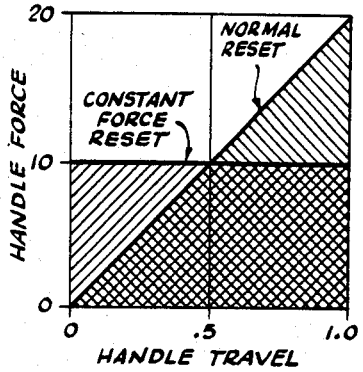
FIG. 18 is a force diagram illustrating the amount of handle force required to reset the device of FIG. 1 as a function of handle travel.

The force diagram of FIG. 18 illustrates handle travel during a reset operation from a TRIPPED (0) position to a RESET (1) position relative to the reset force required to move the handle 42. The NORMAL RESET line illustrates the force required in conventional or prior art circuit breakers having cradles without the contoured cam surface 148 in the cradle 96 to overcome the increasing bias of one or more operating springs as a handle is moved during a reset operation. The CONSTANT FORCE RESET line illustrates the substantially constant reset force required to be applied through the handle 42 to the pin 150 and the cam surface 148 of the cradle 96 to achieve a reset operation. As is apparent, the peak force required during such a reset operation of the operating mechanism 58 having the cradle 96 with the contoured cam surface 148 is substantially reduced from the peak force required in circuit breakers having conventional cradles. The work done during such reset operations corresponds to the areas under the NORMAL RESET line and the CONSTANT FORCE RESET line. The total work done during the reset operation is the same for both the NORMAL RESET line and the CONSTANT FORCE RESET line. However, the reduction in the peak force required for a reset operation by the use of a cradle 96 having the cam surface 148 contoured in a predetermined manner as described hereinabove and as depicted in the drawing enables the use of a motor operator or actuator with a peak power rating corresponding to the comparatively low constant force depicted in FIG. 18 required to move the handle 42.

The engagement of the cam surface 148 of cradle 96 and pin 150 during a reset operation occurs as follows. During a reset operation subsequent to a trip operation, as the handle 42 is moved clockwise from the TRIPPED position (FIG. 15) to and past the OPEN position (FIG. 14), a moment about the longitudinal axis of the cradle support pin 98 occurs due to the application of handle force through the cam pin 150 to the cam surface 148 that substantially counteracts the bias of the operating springs 92. The moment about the longitudinal axis of the pin 98 increases as the pin 150 moves along the surface 148 proportionally to the increase in the distance between the longitudinal axis of the pin 98 and the location of engagement of the pin 150 on the surface 148 that is, the moment arm. Additionally, cam surface 148 is contoured in a predetermined manner to further increase the mechanical advantage of the handle 42 as the handle 42 is moved during the reset operation. During the initial movement of the handle 42, the surface 148 is contoured at a relatively steep angle with respect to the distance between the cam pin 150 and the rotatable cradle support pin 98 since a relatively small force is required to overcome the bias of the springs 92. As the handle 42 is moved further during the reset operation the cam surface 148 is comparatively less steeply contoured providing increased mechanical advantage to the handle 42 to overcome the increased bias of the extended springs 92. This increased mechanical advantage enables a substantially constant reset force to be applied through the handle 42 throughout the reset operation (FIG. 18).

The toggle mechanism 80 includes a pair of rigid, spaced-apart, stationary, pivot-transfer links 158 (FIGS. 5, 13, 16 and 17) that are fixedly secured to the stop pin 90. The stationary links 158 include an elongated, lower surface 160 spaced from an elongated surface 162 formed on the upper toggle links 102. Each stationary link 158 further includes a recess or groove 164 configured for receiving the rotatable cradle support pin 98. The metal side plates 86 include apertures 166 for receiving and retaining the opposite longitudinal ends of the stop pin 90.

The stationary links 158 and the links 102 and 104 enable the "trip-free" operation of the operating mechanism 58 even with the handle 42 physically restricted or obstructed in the CLOSED position, ensuring that the upper electrical contacts 238 are moved out of engagement with the lower electrical contacts 72 upon the initiation of a trip operation by the trip mechanism 82. When the handle 42 is in a CLOSED position (FIG. 16), a pair of first or initial pivot points 163 at the ends of the surfaces 162 of the upper links 102 engage the surfaces 160 of the links 158 near the grooves 164 of the links 158. During a trip operation, the cradle 96 is unlatched by the clockwise rotational movement of the trip arm 144, resulting in the counterclockwise rotation of the cradle 96. The upper links 102 are rotated counterclockwise by the springs 92 about the first pivot point 163. The springs 92 also move the toggle spring pin 106 in a clockwise direction about the pin 110, resulting in corresponding movements of the links 104, the upper contact members 52 and the cross-bar 84. Subsequently, the surfaces 162 of the links 102 physically engage the surfaces 160 of the links 158 and, thereafter, the pivot points are transferred from the initial pivot points 163 to a pair of second pivot points 168, resulting in the increased rotational velocity of the upper contact members 52.

The pivot-transfer system as disclosed herein exhibits a significant mechanical advantage to move the upper links 102 about the first or initial pivot points 163 during the initial counterclockwise rotation of the upper links 102 upon the occurrence of a trip condition and thereby to overcome inertia and to cause the rapid separation of the upper and lower contacts 238 and 72. The pivot transfer from the pivot points 163 to the pivot points 168 accelerates the movements of the upper electrical contact members 52 to rapidly lengthen the electrical arc between contacts 72 and 238 and thus to increase the arc voltage to rapidly extinguish the electrical arc.

Figure 13:
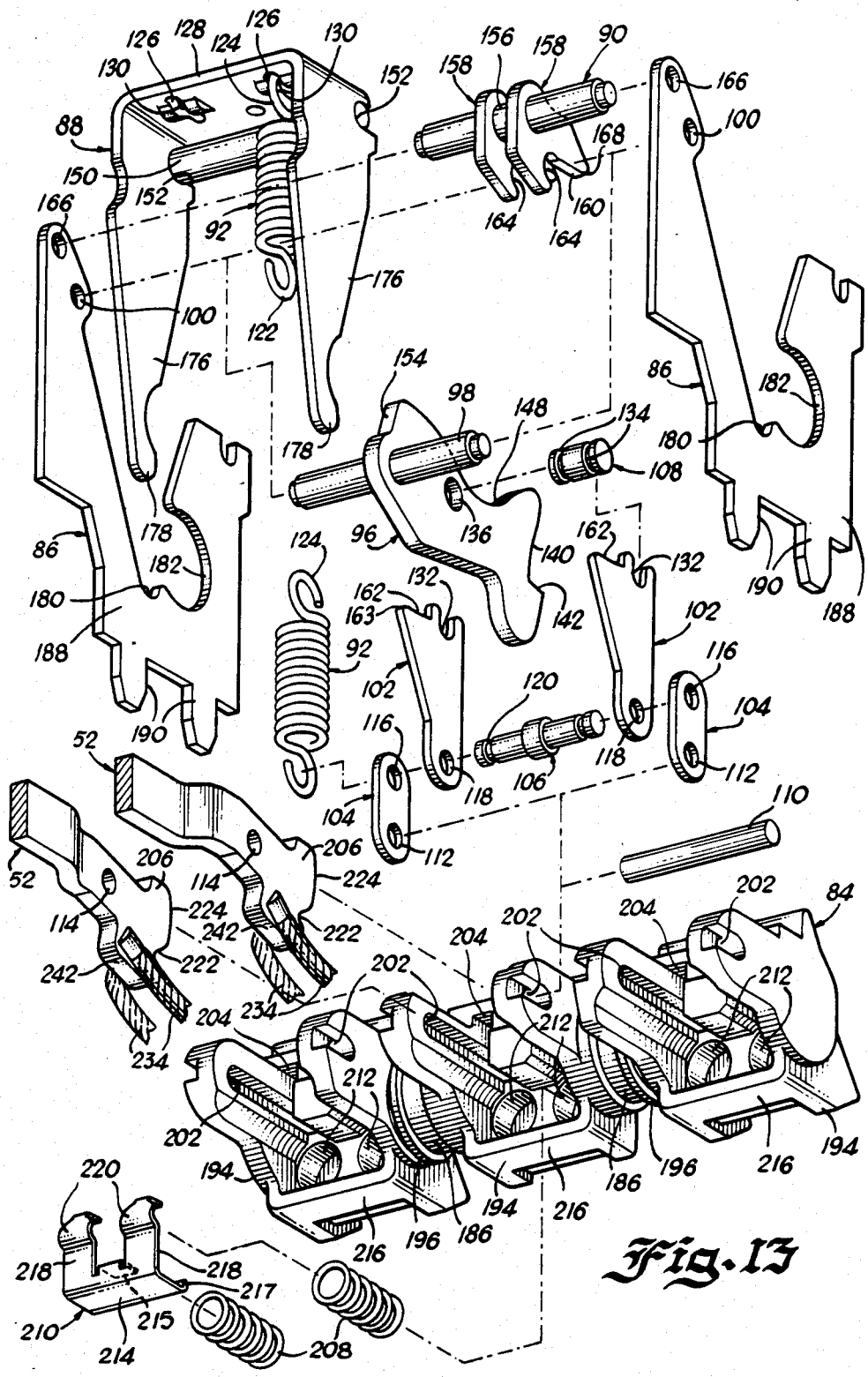
FIG. 13 is an enlarged, exploded, perspective view of portions of the operating mechanism of the device of FIG. 1.

The handle yoke 88 includes a pair of downwardly depending support arms 176 (FIG. 13). A pair of bearing surfaces or rounded tabs 178 are formed at the lowermost extremities of the downwardly depending support arms 176 of the handle yoke 88 for engagement with bearing or pivot surfaces 180 formed in the side plates 86. The handle yoke 88 is thus controllably pivotable about the bearing surfaces 178 and 180. The side plates 86 also include bearing surfaces 182 for contacting round bearing surfaces 186 of the cross-bar 84 and for retaining the cross-bar 84 securely in position within the base 34. Each of the side plates 86 includes a pair of downwardly depending support arms 188 that terminate in elongate, downwardly projecting stakes or tabs 190 for securely retaining the side plates 86 in the circuit breaker 30. In assembling the support plate 86 in the circuit breaker 30, the tabs 190 are passed through apertures 191 formed through the base 34 (FIG. 6). The tabs 190 may then be mechanically deformed, for example, by peening, to lock the tabs 190 in engagement with the base 34. A pair of formed electrically insulating barriers 192 (FIG. 7) is used to electrically insulate conductive components and surfaces in one pole or phase of the circuit breaker 30 from conductive components or surfaces in adjacent poles or phases of the circuit breaker 30.

The integral or one-piece molded cross-bar 84 (FIG. 13) includes three enlarged sections 194 separated by the round bearing surfaces 186. A pair of peripherally disposed, outwardly projecting locators 196 are provided to retain the cross-bar 84 properly located within the base 34. The base 34 includes a plurality of bearing surfaces 198 (FIG. 7) complementarily shaped to the bearing surfaces 186 for seating the cross-bar 84 for rotational movement in the base 34. The locators 196 are received within arcuate recesses or grooves 200 formed along the surfaces 198. Each enlarged section 194 further includes a pair of spaced-apart apertures 202 (FIG. 13) for receiving the toggle contact pin 110. The pin 110 may be retained within the apertures 202 by any suitable means, for example, by an interference fit therebetween. Each enlarged section 194 also includes recess 204 formed therein for receipt of one longitudinal end or base portion 206 of each of the upper electrical contact members 52.

The recess 204 also permits the receipt and retention of a pair of contact arm compression springs 208 (FIGS. 11 and 13) and an associated, formed, spring clip 210. The compression springs 208 are retained in position by being disposed within a pair of spaced-apart recesses 212 formed therein. The spring clip 210 is configured to be disposed between the compression springs 208 and the base portions 206 of the upper electrical contact members 52 to transfer the compressive force from the springs 208 to the base portions 206, thereby ensuring that the upper electrical contact members 52 and the cross-bar 84 move in unison in response to the operation of the operating mechanism 58 during a normal trip operation. However, upon the occurrence of a high level short circuit or fault current condition, the upper electrical contact members 52, responding to the repulsion forces generated between the parallel contact arms 66 and 240, can individually rotate about the pin 110, overcoming the bias forces of the spring 208 and the spring clip 210, thus enabling the electrical contacts 72 and 238 to rapidly separate and move to their BLOWN-OPEN positions (FIGS. 5 and 12, as depicted in dotted lines) without waiting for the operating mechanism 58 to sequence. This independent movement of each of the upper electrical contact members 52 under the above high fault condition is possible in any pole or phase of the circuit breaker 30.

The spring clip 210 (FIG. 12) includes a lower formed portion 214 having an upper tab portion 215 (FIG. 13) and an upstanding end portion 217 for engagement with a complementarily shaped portion 216 of the enlarged section 194 of the cross-bar 84 to properly locate and retain the spring clip 210 in engagement with the enlarged section 194. The spring clip 210 includes a pair of upwardly extending legs 218 for engagement with the compression springs 208. Each upwardly extending leg 218 includes an outwardly projecting surface 220. The terminal portion 206 of each upper contact arm 240 includes a generally C-shaped slot or detent 222 formed in an arcuately shaped surface 224 thereof. The detent 222 and the surface 220 are configured to provide a predetermined, variable amount of compressive force therebetween.

Figures 11, 12, 12A, 12B, 19, 20:
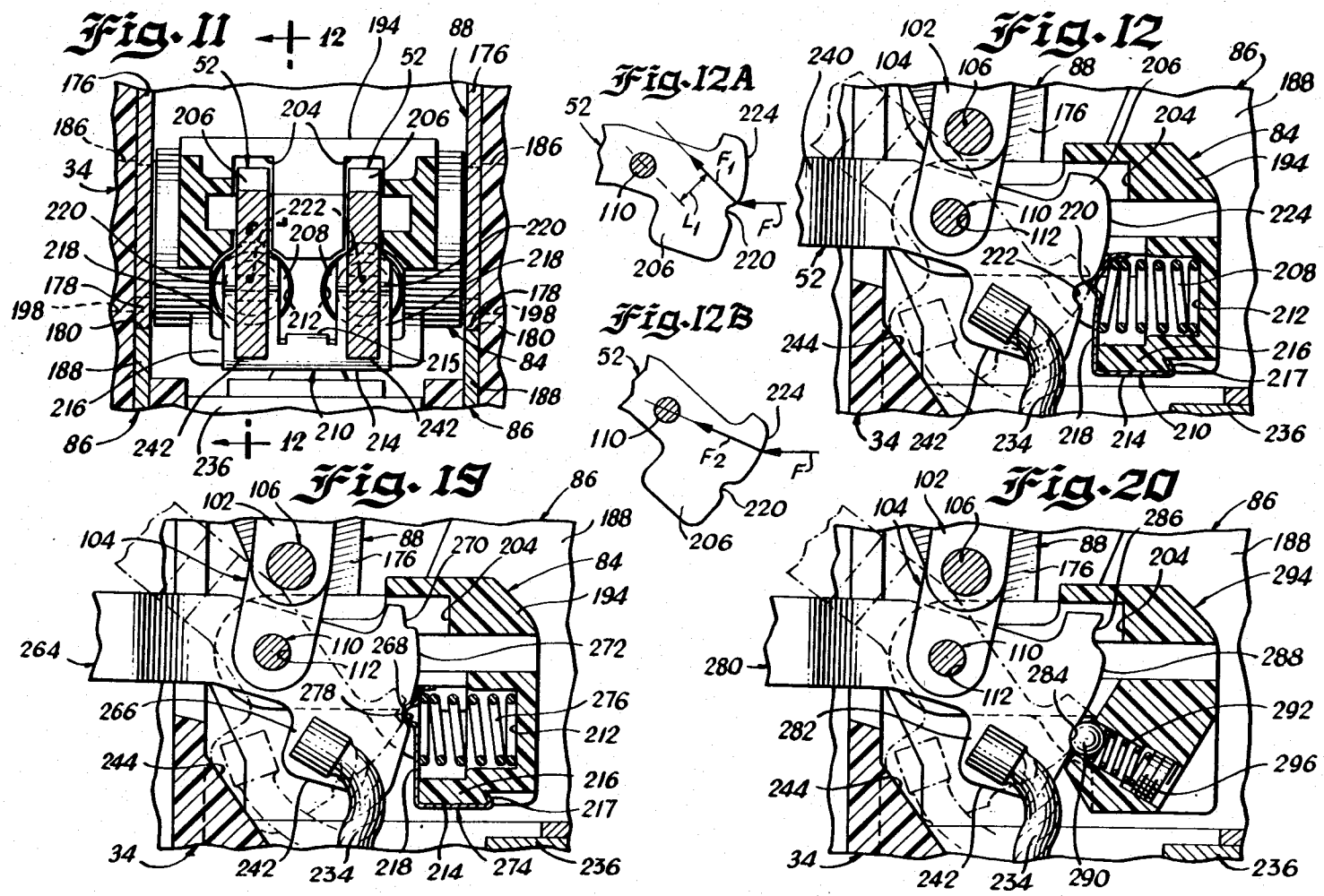
FIG. 11 is an enlarged, fragmentary, cross sectional view of the cross-bar and upper contact assembly of the device of FIG. 1 taken along the line 11—11 of FIG. 5.
FIG. 12 is an enlarged, fragmentary, cross sectional view of the cross-bar and upper contact assembly of the device of FIG. 1 taken along the line 12—12 of FIG. 11.
FIGS. 12A and 12B are enlarged, fragmentary, cross sectional views of a portion of the upper contact assembly of the device of FIG. 1, depicting sequential positions of the upper contact assembly during a BLOWN-OPEN operation.
FIGS. 19, 20 and 21 are each enlarged, fragmentary, cross sectional views, similar to the view of FIG. 12, depicting alternative embodiments of the cross-bar and upper contact assembly for the device of FIG. 1.

During normal operating conditions, the surfaces 220 of the spring clip 210 contact the surfaces 224 of the upper contact arms 240 at the detents or steep cam surfaces 222 thereof to retain the cross-bar 84 in engagement with the upper electrical contact members 52 (FIGS. 5 and 12). Upon the occurrence of a high level short circuit or fault current condition, as each upper contact arm 240 rotates in a clockwise direction about the longitudinal axis of the pin 110, each surface 224 moves along the surface 220. The resultant line of force of the spring 208 through the engaging surfaces 220 and 224 passes substantially through the longitudinal axis of the pin 110 as the upper electrical contact members 52 rotate to their BLOWN-OPEN position (FIGS. 5 and 12), thereby substantially decreasing the compression moment of the springs 208 about the longitudinal axis of the pin 110. Subsequently, when the circuit breaker 30 is reset to its CLOSED position, the arcuate cam surface 224 is moved against the surface 220 to the latch point at the detent 222. By changing the configuration of the detent 222 or the configuration of the cam surface 220 of the spring clip 210, the compression moment arm of springs 208 can be increased or decreased as desired.

Referring to FIGS. 12A and 12B, the base portion 206 of the respective upper electrical contact members 52 is shown in its CLOSED position (FIG. 12A) and in a sequential position (FIG. 12B) during a BLOWN-OPEN operation. The compressive force of the spring 208 is illustrated in FIGS. 12A and 12B by an arrow at the point of engagement of the surfaces 220 (FIG. 12) and 224 and is designated with a reference character F. In the CLOSED position, a component force F1 is directed along a line normal to the tangent of the surface 224 at the point of engagement of the surfaces 220 and 224. The line of action of the force F1 is separated from the longitudinal axis of the pin 110 by a distance shown as L1. The compression moment of the component spring force F1 with the moment arm L1 is provided to ensure that the upper electrical contact members 52, contacts 238, and the cross-bar 84 move in unison in response to the operation of the operating mechanism 58 during a normal trip operation. During a BLOWN-OPEN operation as the upper electrical contact members 52 rotate about the longitudinal axis of the pin 110 (FIG. 12B), the surface 224 is configured to provide a component force F2 of the springs 208 that passes substantially through or close to the pivot of contact members 52 or the the longitudinal axis of the pin 110 to reduce the moment arm to substantially zero. The compression moment of the spring 208 about the longitudinal axis of the pin 110 is substantially reduced thereby ensuring that the upper electrical contact members 52 move independently of the cross-bar 84 to rapidly separate the electrical contacts 72 and 238 during a BLOWN-OPEN operation. The component force F2 is essentially a friction force and the magnitude of force F2 is significantly less than the component force F1. In such manner, the compression springs 208 releasably bias the base portions 206 into driving engagement with the cross-bar 84 for enabling rotational movement of the upper contact members 52 and contacts 238 in unison with the rotational movement of the cross bar 84 and for enabling rotational movement of the upper electrical contact members 52 and contacts 238 substantially independently of the cross bar 84 upon the occurrence of a fault current condition during a BLOWN-OPEN operation.

Two pairs of flexible current shunts 234, as illustrated in FIG. 13, are used to provide a current carrying electrical path through the circuit breaker 30. Each pair of flexible shunts 234 is connected by any suitable means, for example, by brazing, to the opposite sides of the longitudinal end portion 206 of each upper electrical contact member 52 and to a lower conductive plate 236 in the trip mechanism 82. The flexible shunts 234 provide the current carrying electrical path between the upper electrical contact members 52 and the trip mechanism 82 and thereby through the circuit breaker 30 between the terminals 38B and 40B via the lower electrical contact assembly 50, the upper electrical contact members 52, the flexible shunts 234 and the trip mechanism 82.

In operation, the circuit breaker 30 may be interconnected in a three phase electrical circuit via line and load connections to the terminals 38A, B and C and 40A, B and C. The operating mechanism 58 may be set by moving the handle 42 from its TRIPPED position (FIG. 15) as far as possible past its OPEN position (FIG. 14) to ensure the resetting of the latch surface 142 of the cradle 96 and the pivotable trip arm 144.

Subsequent to a trip operation, a force is applied to the handle 42 to move the handle 42 clockwise from its TRIPPED position (FIG. 15) to and past its OPEN position (FIG. 14) to enable relatching of the latch surface 142 of the cradle 96 with the trip arm 144. During such movement of the handle 42, the cam pin 150 engages the cam surface 148 of the cradle 96 and moves the cradle 96 clockwise about the rotatable cradle support pin 98. The clockwise rotation of the cradle 96 results in a corresponding movement of the toggle link follower pin 108 that is fixedly retained within the cradle 96. During such movement, the operating springs 92 rotate clockwise about the toggle spring pin 106 and exert an upward force on the toggle spring pin 106; the kicker links 102 rotate counterclockwise about the upper toggle link follower pin 108 and the lower toggle links 104 are rotated clockwise about the pin 110 that is held in a stationary position within the cross-bar 84. The upward spring force exerted on the toggle spring pin 106 is also applied through the kicker links 102 to the pin 108, thereby providing a counterclockwise biasing force to the cradle 96 about the longitudinal axis of the cradle support pin 98. The handle 42 is moved clockwise past the OPEN position shown in FIG. 14 until the latch surface 142 relatches with the trip arm 144. The handle 42 may then be moved from its OPEN position (FIG. 14) to its CLOSED position (FIG. 5) causing the operating mechanism 58 to close the contacts 72 and 238; and the circuit breaker 30 is then ready for operation in protecting a three phase electrical circuit.

The handle 42 is mved from its OPEN position to its CLOSED position by applying a force to the handle 42 to cause the counterclockwise movement thereof. In the OPEN position, the cradle 96 is provided in its latched position with the latch surface 142 engaging the pivotal trip arm 144 and the grooves 132 of the upper toggle links 102 are retained in engagement with the upper toggle link follower pin 108 that is fixedly received within the cradle 96. During the initial counterclockwise movement of handle 42, the lines of action of the operating springs 92 are to the right to the upper toggle link follower pin 108; the kicker links 102, the lower toggle links 104 and the toggle spring pin 106 are then stationary. As the line of action of the operating springs 92 is moved past the upper toggle link follower pin 108, the kicker links 102 rotate clockwise until the pivot 163 engages the surface 160 of the stationary links 158. Additionally, as a result of the change in the line of action of the operating springs 92 moving past the pin 108, the toggle spring pin 106 rotates clockwise about the upper toggle link follower pin 108 and moves to the left, resulting in the movement of the lower toggle link 104 which rotates counterclockwise about the toggle spring pin 106. Thereby, a cross-bar 84 is rotated counterclockwise and the corresponding movement of the electrical contact members 52 effects the closing of the contacts 72 and 238 with the operating mechanism 58 in the CLOSED position.

Upon the occurrence of a sustained overload condition, the pivotable trip arm 144 pivots about the stationary pin 145 to unlatch the latch surface 142 of the cradle 96. The cradle 96 is immediately accelerated by the operating springs 92 through the kicker links 102 for rotation in the counterclockwise direction resulting in the substantially instantaneous movement of the upper toggle links 102, the toggle spring pin 106 and the lower toggle links 104, as illustrated by the dotted line portions of FIGS. 16 and 17. The upward movement of the pin 106 results in a corresponding upward movement of the toggle contact pin 110 through the movement of the lower toggle links 104, and the immediate, upward movement of the rotatable cross-bar 84 effecting the upward movement of the upper electrical contact members 52 to their TRIPPED position (FIG. 15). Since the base portions 206 of the upper electrical contact members 52 are biased into engagement with the cross-bar 84 through the springs 208, the upper electrical contact members 52 move in unison with the cross-bar 84, resulting in the simultaneous or synchronous separation of all three of the pairs of upper electrical contacts 238 from the lower electrical contacts 72 in the circuit breaker 30. During this trip operation, any electrical arc that may have been present across the contacts 72 and 238 is lengthened, subdivided by the arc chute 54 and, in the normal course of events, extinguished.

Upon the occurrence of a high level short circuit or fault current condition and as a result of the large magnetic repulsion forces generated by the flow of fault current through the generally parallel contact arms 66 and 240, the electrical contacts 72 and 238 rapidly separate and move to their BLOWN-OPEN positions (depicted in dotted line portion of FIG. 5). Movement of the contact arm 66 of the lower electrical contact assembly 50 is limited by the stop surface 34B, and movement of each contact arm 240 of each upper electrical contact member 52 is limited by the engagement of a lower contacting surface 242 (FIG. 12) of the terminal portion 206 of the contact arm member 52 and a stop surface 244 formed in the base. Each contact arm 240 is held in its BLOWN-OPEN position by the engagement of the surfaces 220 and 224. The separation of the electrical contacts 72 and 238 may thus be achieved without the necessity of the operating mechanism 58 sequencing through a trip operation.

The position indicator 46 (FIGS. 1, 3–5 and 14–17) of the circuit breaker 30 provides an externally visually discernible indication of the condition or position of the operating mechanism 58 of the circuit breaker. The position indicator 46 includes a plurality of insulating cards, strips or barriers, for example, as specifically illustrated, a first or upper electrically insulating card, strip or barrier 246 and a second or lower electrically insulating card, strip or barrier 248 that cooperate to provide an external, clear indication of the position or condition of the operating mechanism 58. The barriers 246 and 248 are disposed about the handle 42 and cover the bottom of the opening 44 to function as a mechanical and electrical barrier between the interior and exterior of the circuit breaker 30. Preferably, the top cover 32 includes a pair of spaced apart, laterally aligned openings or viewing slots 250 formed therethrough to provide external visual access to either a pair of spaced apart, laterally aligned position indicia or red markings 252 (FIG. 4) fixedly secured to, or on, the barrier 246 or a pair of spaced apart, laterally aligned position indicia or white markings 254 fixedly secured to, or on, the barrier 246 or a pair of spaced apart, laterally aligned position indicia or green markings 256 fixedly secured to, or on, the upper surface of the barrier 248.

The barrier 246 has a relatively small slot 258 that fits securely about the handle 42. The barrier 248 has, comparatively, a much larger slot 260 that enables relative movement between the barriers 246 and 248 and also between the barrier 248 and the handle 42. The barrier 248 also is dimensionally longer along the longitudinal axis of the opening 44 than the barrier 246 in order to ensure that the green markings 256 may be externally visually discerned when aligned with the viewing slots 250 and to ensure that the opening 44 is covered in all positions of the handle 42.

When the handle 42 is moved in the opening 44 to its ON or CLOSED position, the red markings 252 are positioned in the viewing slots 250 to provide an externally visually discernible indication that the operating mechanism 58 of the circuit breaker 30 is in its CLOSED position (FIG. 5). Upon a trip operation of the circuit breaker 30, the handle 42 moves to the load side of the circuit breaker 30 (FIG. 15). The barrier 246, captured about the handle 42, moves with the handle 42 to position the white markings 254 in the viewing slots 250, providing an externally visible indication that the operating mechanism of the circuit breaker 30 is in its TRIPPED position (FIG. 15). During this movement of the handle 42 the lower barrier 248 is not moved as the handle 42 moves within the slot 260. When the handle 42 is moved to its OFF or OPEN position in the opening 44, the barrier 246 is moved beyond the viewing slots 250 and the green markings 256 on the barrier 248 are positioned in the viewing slots 250 to provide an external visually discernible indication that the operating mechanism 58 is in its OPEN position (FIG. 14).

A plurality of spaced apart insulating support members 262 (FIGS. 3 and 5), preferably integrally formed portions of the top cover 32, is used to provide lateral support of the longitudinal end of the barrier 248 when the handle 42 is in its OPEN position in order to prevent substantial internal deflection of the barrier 248 upon the application of an external force. The use of the two barriers 246 and 248 with the colored markings 252, 254 and 256 disposed thereon is particularly advantageous in applications where maximum movement is required in a limited amount of space, since the lost motion connection between the handle 42 and the barrier 248 enables a shorter barrier 248 to be used than would be required in the absence of the lost motion connection.

In accordance with an altenative embodiment (FIG. 19) of the circuit breaker 30, identical reference characters as used hereinabove with respect to FIGS. 1–17 are employed hereinafter to describe unchanged portions and common components of the circuit breaker 30, each of a pair of upper electrical contact members 264 includes a longitudinal end or base portion 266. The terminal portions 266 include a lower groove or detent 268 and an upper groove or detent 270 formed along an arcuate surface 272 thereof. A spring clip 274 is disposed between a pair of compression springs 276 and the base portions 266 of the upper electrical contact members 264 to transfer the compressive force from the springs 276 to the base portions 266, thereby ensuring that the upper electrical contact members 264 and the cross-bar 84 move in unison in response to movement of the handle 42 or the operation of the operating mechanism 58 during a normal trip operation. The spring clip 274 includes an outwardly projecting surface 278 formed in each of the upstanding legs 218 for engaging the arcuate surface 272 of the base portions 266 of the upper electrical contact members 264. As described hereinbefore with respect to FIGS. 12A and 12B, the lower detents 268 and the surfaces 278 are configured to provide a compression moment of the component force F1 about the longitudinal axis of the pin 110 proportional to the distance L1 between the longitudinal axis of the pin 110 and the resultant line of force of the spring 212 through the engaging surfaces 278 and 272. That moment may be varied as desired by appropriately contouring the arcuate surfaces 272. The springs 212 releasably bias the base portions 242 of the upper contact members 264 into driving engagement with the cross-bar 84 enabling rotational movement of members 264 (in unison with the cross-bar 84) and enabling rotational movement of the members 264 substantially independently of the cross-bar 84 upon the occurrence of a fault current condition during a BLOWN-OPEN operation. The frictional force F2 (FIG. 12B) passes substantially through the longitudinal axis of the pin 110 and is significantly less than F1 (FIG. 12A), as is described hereinbefore.

During normal operating conditions, the protruding surface 278 of the spring clip 274 contacts the lower detent 268 of the upper electrical contact members 264 to retain the cross-bar 84 in driving engagement with the upper electrical contact members 264. Upon the occurrence of a high level short circuit or fault current condition, as the upper electrical contact members 264 rotate in a clockwise direction about the longitudinal axis of pin 110, the arcuate surface 272 of the base portion 266 is moved against the surface 278. The resultant line of force of the spring 212 through the engaging cam surfaces 278 and 272 passes substantially through the longitudinal axis of the pin 110 as the upper electrical contacts 264 rotate to their BLOWN-OPEN position (FIG. 19, in dotted line), thereby substantially reducing the moment imparted by the springs 276 about the longitudinal axis of the pin 110. The upper detent 270 engages the outwardly projecting cam surface 278 of the spring clip 274 in the BLOWN-OPEN position to retain the upper electrical contact members 264 in their BLOWN-OPEN position, thereby eliminating or minimizing the possibility of contact restrike.

In accordance with a further alternative embodiment (FIG. 20) of the circuit breaker 30, each of a pair of upper electrical contact members 280 includes a longitudinal end portion 282 that includes a lower groove or detent 284 and an upper groove or detent 286 formed along an arcuate cam surface 288 thereof.

A ball 290 is disposed between the arcuate surface 288 of each base portion 282 and one of a pair of compression springs 292 that are retained within a cross-bar 294. An adjusting screw or threaded plug 296 engages the compression spring 292 to provide a desired spring force on the ball 290. The balls 290 transfer the compressive force from the springs 292 to the base portions 282, thereby ensuring that the upper electrical contact members 280 and the cross-bar 294 move in unison in response to movement of the handle 42 or the operation of the operating mechanism 58 during a normal trip operation. During normal operating conditions, the ball 290 engages the lower detent 284 of the upper electrical contact members 280 and transfers the compressive spring force thereto.

Upon the occurrence of a high level short circuit or fault current condition, as the upper electrical contact members 280 rotate in a clockwise direction about the longitudinal axis of pin 110, the arcuate surfaces 288 of the base portions 282 are moved against the balls 290. As described hereinbefore with respect to FIGS. 12A and 12B, the component force of the springs 292 is significantly reduced from F1 with the moment arm L1 in the CLOSED position to frictional force F2 that passes substantially through the pivot of members 280 or the longitudinal axis of pin 110 in the subsequent position as the upper electrical contact members 280 rotate about the longitudinal axis of the pin 110 during a BLOWN-OPEN operation. The upper detents 286 engage the balls 290 in the BLOWN-OPEN position, holding the contact members 280 in their BLOWN-OPEN position, thereby eliminating or minimizing the possibility of contact restrike. Subsequently, when the circuit breaker 30 is reset to its CLOSED position, the arcuate surfaces 288 are moved against the balls 290 until the balls 290 are disposed in the lower detents 284.

Figure 21:
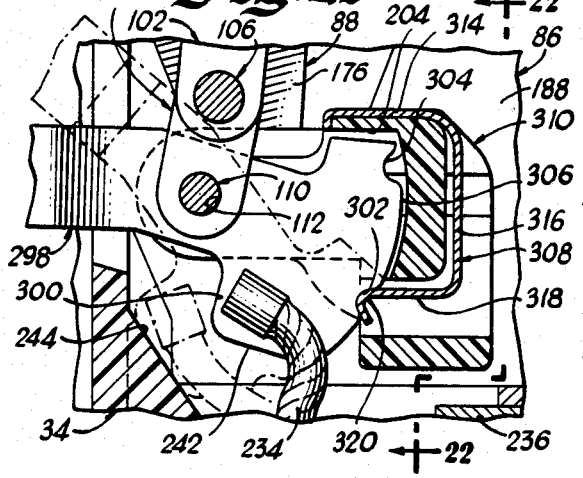
Figure 22:
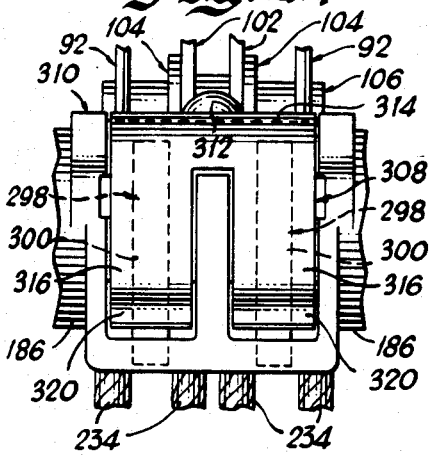
FIG. 22 is an enlarged, fragmentary, cross sectional view of the assembly of FIG. 21 taken along line 22—22 of FIG. 21.

In accordance with another alternative embodiment (FIGS. 21 and 22) of the circuit breaker 30, each of a pair of upper electrical contact members 298 includes a longitudinal end or base portion 300 having a lower groove or detent 302 and and an upper groove or detent 304 formed along an arcuate surface 306. A metal leaf spring 308 is secured to a molded cross-bar 310 by a fastener 312 and is disposed between the base portions 300 of the upper electrical contact members 298 and the cross-bar 310. The leaf spring 308 includes an upper, generally flat portion 314 that engages the cross-bar 310 and that has an aperture (not illustrated) formed therethrough for receiving the fastener 312 to secure the leaf spring 308 to the cross-bar 310. The leaf spring 308 further includes a pair of downwardly depending arms 316 with lower, integrally formed, laterally extending portions 318 thereof. Each lower portion 318 includes an outwardly projecting surface 320 formed thereon. The leaf spring 308 is configured to be disposed about the cross-bar 310 with the cam surfaces 320 thereof provided in contacting engagement with the arcuate surfaces 306 of the base portions 300 of the upper electrical contact members 298. The leaf spring 308 is formed to provide a predetermined spring force to the base portions 300 to ensure that the upper electrical contact members 298 and the cross-bar 310 move in unison in response to movements of the handle 42 and of the operating mechanism 58 during a normal trip operation.

During normal operation, the surfaces 320 of the leaf spring 308 engage the lower detents 302 of the base portions 300. Upon the occurrence of a high level short circuit or fault current condition, the upper electrical contact members 298 rotate about the pin 110 and the surfaces 306 move along the surfaces 320 of the leaf spring 308 enabling the electrical contacts 72 and 238 to rapidly separate and to move to their BLOWN-OPEN positions (FIG. 21, in dotted line) without waiting for the operating mechanism 58 to sequence. As described hereinbefore with respect to FIGS. 12A and 12B, the component force of the leaf spring 308 is significantly reduced from F1 with the moment arm L1 in the CLOSED position to the frictional force F2 that passes substantially through the pivot of members 298 or the longitudinal axis pin 110 in the subsequent position as the upper electrical contact members 298 rotate about the longitudinal axis of the pin 110 during a BLOWN-OPEN operation. The upper detents 304 engage the surfaces 320 to retain the upper electrical contact members 298 in their BLOWN-OPEN position, thereby eliminating or minimizing the possibility of contact restrike. The leaf spring 308 provides sufficient spring force to ensure proper contacting engagement between the upper electrical contact members 298 and the cross-bar 310 without the necessity for one or more compression springs.

Figure 23:
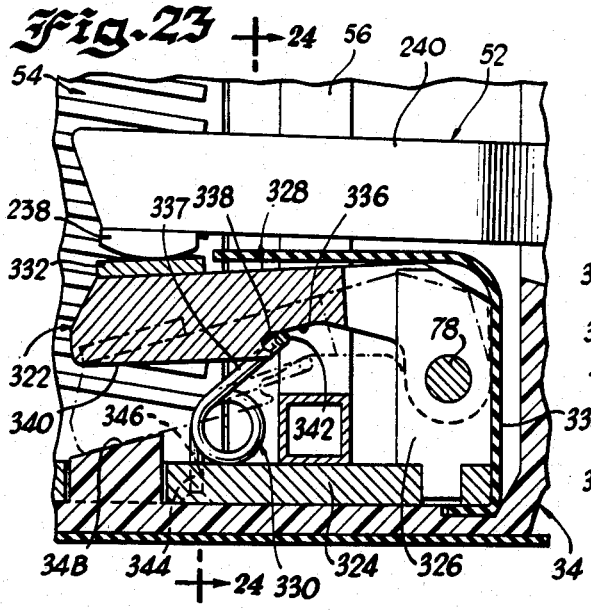
FIG. 23 is an enlarged, fragmentary, cross sectional view of an alternative embodiment of a lower contact for the device of FIG. 1.
Figure 24:
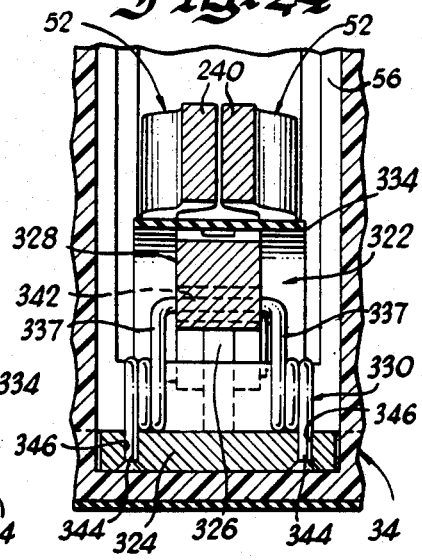
FIG. 24 is an enlarged, fragmentary, cross sectional view of the lower contact of FIG. 23 taken along line 24—24 of FIG. 23.

In accordance with a further alternative embodiment (FIGS. 23 and 24) of the circuit breaker 30, a lower electrical contact assembly 322 includes a lower, formed, stationary conductor member 324 that is secured to the base 34, an upstanding contacting portion 326, a lower movable contact arm 328, a lower contact biasing means such as a torsion spring 330, a lower contact 332 for physically and electrically contacting the upper electrical contact 238 and an electrically insulating strip 334 to reduce the possibility of arcing between the upper electrical contact members 52 and portions of the lower electrical contact assembly 322. The movable lower contact arm 328 is fixedly secured to the rotatable pin 78 for rotation therewith on the upstanding contacting portion 326 about the longitudinal axis of the rotatable pin 78. The underside of the movable lower contact arm 328 is contoured to provide an inclined, elongated cam surface 336 having a recess or groove 338 formed at one end thereof. The movable lower contact arm 328 further includes an integrally formed, generally flat, limit surface 340 formed at one end for contacting the stop 34B to limit the downward movement of the movable lower contact arm 328 and the lower contact 332 fixedly secured thereto.

The torsion spring 330 includes an upper elongated spring arm 342 for engaging and following the cam surface 336 and a pair of spaced-apart, elongated, downwardly extending support arms 337 terminating in a pair of coil extensions 344 for securely retaining the torsion spring 330 in the circuit breaker 30. In assembling the lower electrical contact assembly 322 in the circuit breaker 30, the extensions 344 of the torsion spring 330 are first passed through a pair of apertures 346 formed through the lower formed stationary conductor member 324 and the legs 344 are then mechanically deformed to lock the spring 330 in engagement with the stationary conductor member 324. The torsion spring 330 is configured as described herein and as depicted in the drawing to provide the required spring force to ensure that the lower electrical contact assembly 322 is properly biased into engagement with the upper electrical contact members 52 and this provide reliable operation over an extended period of time.

As described hereinabove with respect to the lower electrical contact assembly 50, the lower contact assembly 322 utilizes the high magnetic repulsion forces generated by high level short circuit or fault current flowing through the elongated parallel portions of the electrical contact arms 240 and 328 to cause the rapid downward movement of the lower movable contact arm 328 against the bias of the torsion spring 330.

Upon the occurrence of a high level short circuit or fault current condition, the lower movable contact arm 328 rotates in a counterclockwise direction about the longitudinal axis of the pin 78 and is downwardly deflected, thus forcing the arm 342 of the spring 330 to move along the surface 336 of the lower movable contact arm 328. The downward deflection of the movable contact arm 328 is limited by the engagement of the flat surface 340 of the contact arm 328 with the stop 34B. The angle of inclination of the inclined cam surface 336 effectively reduces the spring force applied to the movable contact arm 328 after the upper and lower contacts 238 and 332 separate thus minimizing the spring force opposing the downward movement of the contact assembly 322 during a fault current condition. In addition, the moment arm of the spring force (applied by the spring arm 342, about the axis of the pin 78) is reduced while, simultaneously, the mechanical advantage of the above-mentioned high magnetic repulsion forces increases as the spring arm 342 moves along the cam surface 336 in the direction of the pin 78. Consequently, the resultant force opposing the downward movement of the lower contact assembly 322 during a fault current condition is substantially reduced.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent is:

1. An electrical circuit breaker comprising;

a first electrical contact assembly having a first contact, and a second movable electrical contact assembly having a second contact, said first and second electrical contact assemblies being movable into a CLOSED position and into an OPEN position, said second movable electrical contact assembly comprising a stationary conductor member having a first longitudinal end forming an external electrical terminal of said circuit breaker and a second longitudinal end configured as an upstanding contacting portion disposed within said circuit breaker, said second movable contact assembly further comprising (a) a movable contact arm having said second contact fixedly secured thereto at one longitudinal end thereof and (b) means fixedly secured to said movable contact arm and remotely disposed from said second contact for rotatably engaging the upstanding contacting portion of said stationary conductor member, said movable contact arm including an elongated cam surface formed along a portion thereof, said second movable electrical contact assembly further comprising biasing means for biasing said second contact on said movable contact arm into engagement with said first electrical contact when said first and second contact assemblies are in CLOSED position, said biasing means comprising a torsion spring disposed to engage the cam surface of said movable contact arm.

2. An electrical circuit breaker as recited in claim 1 wherein said torsion spring has a first elongated arm for engaging the elongated cam surface of said movable contact arm and thereby transferring spring force from said torsion spring to said movable contact arm.

3. An electrical circuit breaker as recited in claim 2 wherein said first spring arm is movable along the length of the elongated cam surface of said movable contact arm during the separation of said first and second electrical contacts upon the occurrence of a fault current condition.

4. An electrical circuit breaker as recited in claim 1 wherein said movable contact arm includes a recess formed along the elongated cam surface therefore, said torsion spring including a first elongated arm capable of being removably disposed in said recess.

5. An electrical circuit breaker as recited in claim 1 further comprising a molded case formed from electrically insulating material within which said first and second electrical contact assemblies are disposed, said molded case including an interior surface having an upwardly protuberant portion for engaging said movable contact arm to limit the movement of said movable contact arm.

6. An electrical circuit breaker as recited in claim 1 wherein said torsion spring includes a second elongated arm disposed in contact with said stationary conductor member.

7. An electrical circuit breaker as recited in claim 1 wherein the elongated cam surface of said movable contact arm is inclined at an angle to minimize the spring force applied thereto by said torsion spring during the separation of said first and second contacts upon the occurrence of a fault current condition.

8. An electrical circuit breaker comprising;

a first electrical contact assembly having a first contact, and a second electrical contact assembly having a second contact, said first and said second electrical contact assemblies being movable into a CLOSED position and into an OPEN position;

said second electrical contact assembly comprising a stationary conductor member having a first longitudinal end forming an external electrical terminal of said circuit breaker and a second longitudinal end disposed within said circuit breaker and configured as an upstanding contacting portion, said second electrical contact assembly further comprising a movable contact arm having said second contact fixedly secured thereto at one longitudinal end thereof and means fixedly secured to said movable contact arm and remotely disposed from said second contact for rotatably engaging the upstanding contacting portion of said stationary conductor member and effecting an electrical connection therewith, said movable contact arm including an elongated cam surface of inclined configuration, said second electrical contact assembly further comprising spring means for biasing said movable contact arm, said spring means comprising a torsion spring having a first elongated arm disposed in engagement with said elongated inclined cam surface.

9. An electrical circuit breaker as recited in claim 8 wherein said movable contact arm includes a groove formed at one end of said elongated cam surface, the first arm of said torsion spring being removably disposed in said groove when said first and second contact assemblies are in CLOSED position.

10. An electrical circuit breaker as recited in claim 8 wherein the first arm of said torsion spring is movable along the length of said elongated inclined cam surface upon the occurrence of a fault current condition.

11. An electrical circuit breaker as recited in claim 8 further comprising a molded case formed from electrically insulating material within which said first and second electrical contact assemblies are disposed, said molded case including an interior surface having an upwardly protuberant portion for engaging said movable contact arm and constituting a stop means that limits the movement of said movable contact arm when said first and second contact assemblies are moved from CLOSED to OPEN position.

12. An electrical circuit breaker as recited in claim 8 wherein said torsion spring includes a second elongated arm that is mechanically locked in contact with said stationary conductor member.

13. An electrical circuit breaker as recited in claim 8 wherein the angle of inclination of the elongated cam surface of said movable contact arm is such that the spring force applied thereto by said torsion spring is reduced after the separation of said first and second contact assemblies upon the occurrence of a fault current condition and the spring force opposing further movement of said movable contact arm is thus minimized.

* * * * *